US008776695B2

(12) United States Patent
Ho et al.

(10) Patent No.: US 8,776,695 B2
(45) Date of Patent: Jul. 15, 2014

(54) SUPPORT SLEEVE FOR A TRACK RISER

(76) Inventors: Wai Hoe Ho, Plano, TX (US); Bee Toh Siow, Richardson, TX (US)

( * ) Notice: Subject to any disclaimer, the term of this patent is extended or adjusted under 35 U.S.C. 154(b) by 71 days.

(21) Appl. No.: 13/601,813

(22) Filed: Aug. 31, 2012

(65) Prior Publication Data

US 2014/0060376 A1 Mar. 6, 2014

(51) Int. Cl.
*E04H 12/00* (2006.01)

(52) U.S. Cl.
USPC ..... 104/125; 104/124

(58) Field of Classification Search
USPC ..... 104/124, 125
See application file for complete search history.

(56) References Cited

U.S. PATENT DOCUMENTS

| | | | | |
|---|---|---|---|---|
| 1,828,536 | A | 10/1931 | Koerber | |
| 2,919,515 | A | 1/1960 | Connell et al. | |
| 3,225,487 | A | 12/1965 | Mallalieu | |
| 4,096,658 | A * | 6/1978 | Neuhierl | 446/119 |
| 4,826,076 | A * | 5/1989 | Hesse | 238/10 R |
| 5,456,410 | A * | 10/1995 | Chow | 238/10 R |
| 5,826,835 | A | 10/1998 | Wilson et al. | |
| 5,979,783 | A | 11/1999 | Toht et al. | |
| 6,612,533 | B2 * | 9/2003 | Biles et al. | 248/354.1 |
| 6,647,893 | B1 * | 11/2003 | Fugitt et al. | 104/69 |
| 8,113,122 | B2 * | 2/2012 | Tarr | 104/124 |
| 8,215,567 | B1 * | 7/2012 | Schleuter | 238/10 E |

* cited by examiner

*Primary Examiner* — Jason C Smith
(74) *Attorney, Agent, or Firm* — Law Office of Sam Sokhansanj PLLC

(57) ABSTRACT

The present invention is for a support sleeve for a riser supporting an elevated toy vehicle trackway above a surface, the sleeve comprising a first end, a second end having an open end, one or more walls extending between the first end and second end, wherein the one or more walls define a hollow interior for supporting the riser, and one or more supports extending outwardly from the perimeter of the first end. The one or more supports form a shoulder extending outwardly from the first end, wherein the shoulder encircles the perimeter of the first end. The present invention further provides a method of stabilizing one or more toy vehicle tracks mounted on one or more track risers, comprising inserting a first track riser within a hollow support sleeve having a top end and a base end, the base end having one or more outwardly projecting supports.

18 Claims, 3 Drawing Sheets

SUPPORT SLEEVE FOR A TRACK RISER

BACKGROUND

The invention relates to a device for stabilizing the support pillars or risers of elevated tracks for toy vehicles, in particular tracks consisting of trackway segments which are plugged together and form driving lanes designed to be driven on which are spaced above the surface on which such trackways are set up.

The desire for playing with track bound toy vehicles is well known. More specifically, track bound toy vehicles having extended tracks or driving track segments with a spacing above the surface on which the trackway is set up. For this purpose, the driving tracks or driving track segments have to be supported by supporting elements, for example blocks, pillars, or certain track risers, supporting such tracks with suitable spacings. It is understood that this type of support for the trackway segments leads only to unstable trackways. For example, when using blocks as risers, the block may be mounted on an unstable surface, such as carpet, rugs, or any other offset or inherently unstable surface, causing the blocks to fall over, such as from the weight of the toy vehicle on the tracks, the momentum of the toy vehicle, or inadvertent knocking over of the tracks or blocks by the user, among others. In addition, as more risers or blocks are mounted on top of each other to adjust the elevation of the track, the risers and track become even more inherently unstable. This instability of the track has an adverse effect on the user's desire to play with such toys. Thus, there is a need for a device that improves the stability of these track risers.

BRIEF SUMMARY OF THE INVENTION

The objective of the invention is an apparatus that stabilizes and supports track risers which in turn support elevated driving track segments for a toy vehicle.

In the preferred embodiment, a support sleeve is provided for enclosing a track riser. The support sleeve having a base and one or more walls extending upward from the base which enclose a hollow space and define an open top. The base further includes an extended shoulder or flange region around its perimeter, thereby providing a stabilizing support for the sleeve, riser, and track assembly above a surface.

In other embodiments, one or more support sleeve are provided that enclose one or more track risers, the one or more support sleeves mounted on top of each other supporting the one or more mounted support risers to provide a higher elevation for a track above any surface. The configuration and arrangement of the stacked one or more sleeves provide a stable support for the one or more risers, and one or more tracks above a surface.

Other advantages, benefits, and features of the present invention will become apparent to those skilled in the art upon reading the detailed description of the invention.

DETAILED DESCRIPTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring now to FIG. 1-6, which illustrate the preferred embodiment of the invention, a support sleeve 10 is shown which serves the purpose of stabilizing one or more track risers (not shown in) for toy vehicle trackway assembly, such as toy trains, toy cars, or other one or more wheeled toys. The trackway can also be a single or double rail assembly or one or more grooves or channels within the trackway forming rails for the toy vehicle. It will be understood that the invention is not limited to toys for children, but can include other hobby, model train, or model vehicle sets for adolescents or adults.

Figure 1:
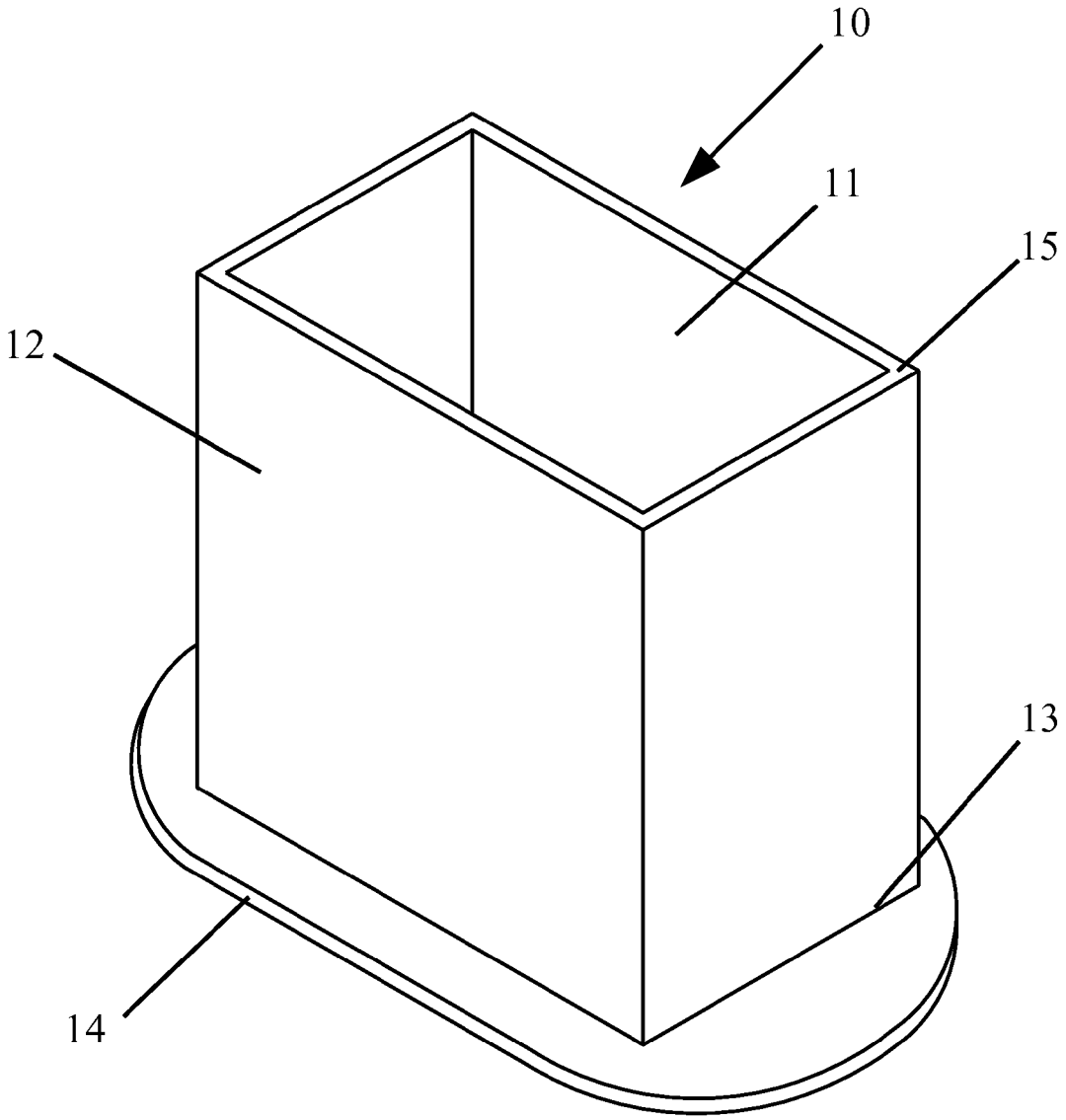
FIG. 1 shows a perspective view of the sleeve support device.
Figure 2:
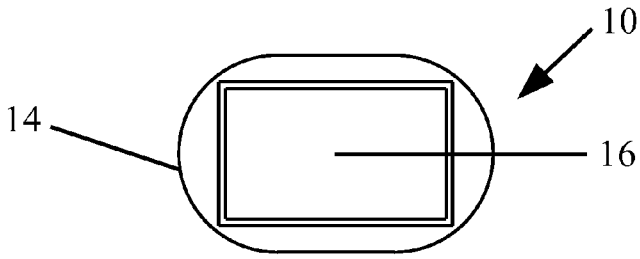
FIG. 2 shows a top view of the sleeve support device.
Figure 3:
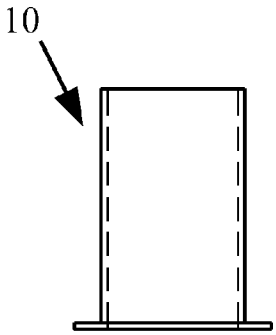
FIG. 3 shows a right side view of the sleeve support device
Figure 4:
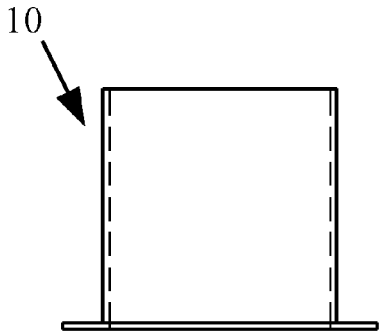
FIG. 4 shows a front side view of the sleeve support device, the back side view being a mirror image of the front side view.
Figure 5:
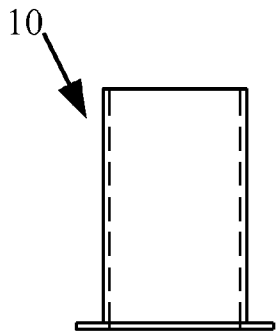
FIG. 5 shows a left side view of the sleeve support device.
Figure 6:
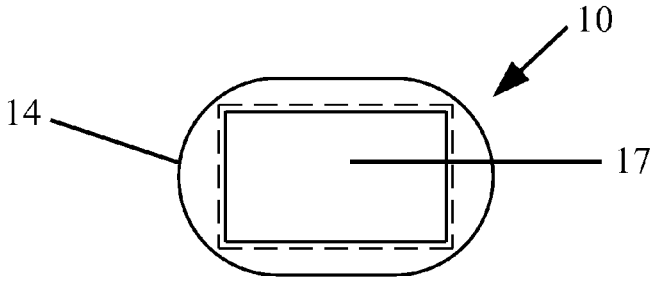
FIG. 6. shows a bottom view of the sleeve support device.

Still referring to FIGS. 1-6, the support sleeve 10 has a first end or base 13 that forms an open end 17 and a second or top end 15 that also forms an open end 16. The first end 16 forms the base having one or more walls 12 extending upwardly. The base can rest on any type of any surface, including but not limited to flat, incline, decline, offset, or rugged surfaces of any material or earth materials. It is apparent within the scope of the invention that the first end can also be a closed end. The walls 12 define an open hollow space 11 within the sleeve. Further, a shoulder 14 extends laterally from the base 13 thereby providing a stable support on any surface for the sleeve, track riser, and track assembly. In the preferred embodiment, shoulder 14 is an outwardly projecting flange that encircles the entire base 13 region around its perimeter. In another embodiment, the shoulder can either be situated in a substantially perpendicular or partially angled configuration with respect to the walls 12. Shoulder 14 can also include one or more laterally extending feet or supports arranged perpendicular or slightly angled with respect to the walls 12, or one more outwardly extending legs from base 13 that are substantially parallel with the walls 12. Further, shoulder 14 is not limited to the size, width, and length as depicted in FIG. 1, and can encompass any size, width, or length. It is further understood that the walls 12 can encompass any configuration, such as rectangular, square, cylindrical, ellipsoid, oval, triangular, pentagon, parallelogram, or any other polygon having three or more sides. Further, the walls 12 can be of any height, width, or depth, and the support sleeve in its entirety can be of any width, height, shape or dimension. It is further contemplated that the sleeve 10 can be molded or manufactured as one unitary piece or of one or more of the walls 12, base 13, or shoulder 14 being separate components and assembled together. In addition, it is contemplated within the scope of the invention that the track risers can be any type of block, solid or hollow material made of materials including but not limited to wood, plastic, cardboard, paper, fiberglass, metal, or rubber. The risers can also take on any shape, configuration, or dimension. It is further contemplated that the support sleeves can be retrofitted with pre-existing risers currently on the market, including but not limited to the Thomas & Friends® series of risers and tracks.

Figure 7:
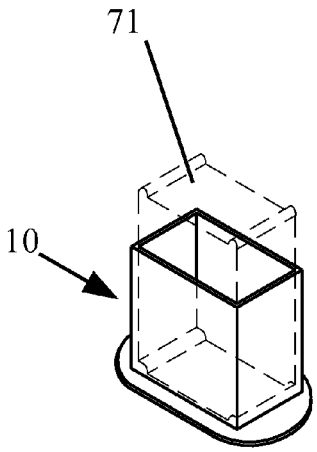
FIG. 7 shows a perspective view of one embodiment of the invention showing one sleeve support device situated over one track riser.

Referring now to FIG. 7, which further illustrates the preferred embodiment of the invention, the support sleeve 10 is shown with a track riser 71 placed within the interior space of sleeve 10. It is contemplated that riser 71 can slide in and out of sleeve 10 with relative ease and the configuration of sleeve 10 substantially matches the configuration of riser 71 and hence complement each other. It is further contemplated that sleeve 10 can either substantially enclose riser 71 or at least partially enclose riser 71. The support sleeve 10, via it's shoulder base region, provides a stable support for the riser 71 and track (not shown) on any surface.

Figure 8:
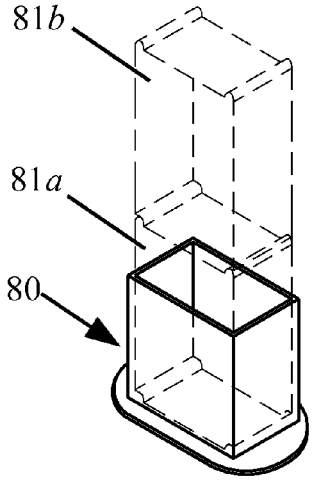
FIG. 8 shows a perspective view of another embodiment of the invention showing one support sleeve device situated over two or more stacked track risers.

Referring now to FIG. 8, which illustrates another embodiment of the invention, where it is desired to raise the elevation of the track to a higher level, with at least two risers and at least one support sleeve acting as a stabilizer. Here, a support sleeve 80 is shown with a first track riser 81*a* placed within the interior space of sleeve 80. Further, a second track riser 81*b* is shown to be placed, stacked, or mounted on top of the first track riser 81*a*. The support sleeve 80, via its shoulder base region, provides a stable support for the riser 81*a* and 81*b*, and the entire track assembly (not shown) on any surface.

Figure 9:
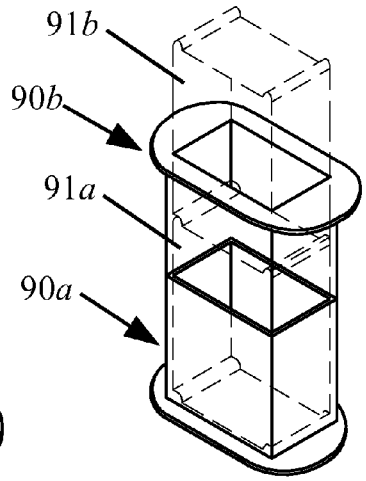
FIG. 9 shows a perspective view of another embodiment of the invention having two or more support sleeves stacked on top of each other supporting two or more stacked track risers and a trackway supported on the risers.

Referring now to FIG. 9, which illustrates another embodiment of the invention, where it is desired to raise the elevation of the track to a higher level, with at least two support sleeves acting as stabilizers. Here, a support sleeve 90*a* is shown with a first track riser 91*a* placed within the interior space of sleeve 90*a*, a second track riser 91*b* placed, stacked, or mounted on top of first track riser 91*a*. In this embodiment, second support sleeve 90*b* is placed, stacked, or mounted on top of first support sleeve 90*a* in an inverted or upside-down configuration with the shoulder region facing up. However, it is apparent within the scope of the invention that the second support sleeve can be placed on top of first support sleeve with its shoulder region facing down. In this embodiment, support sleeve 90*b* partially encloses the top region of riser 91*a* and the bottom region of riser 91*b*. This configuration prevents risers 91*a* and 91*b* from breaking or slipping apart from their mating or junction point due to their partially enclosed nature within second support sleeve 90*b*, wherein sleeve 90*b* provides a form of lock or barrier around the mating point of risers 91*a* and 91*b*, while support sleeve 90*b* rests on top of first support sleeve 90*a*. The combination of first support sleeve 90*a*, via its shoulder base region on any surface, the second support sleeve 90*b*, via its partial enclosure of risers 91*a* and 91*b*, provide a stable support for the risers 91*a* and 91*b*, and the entire track assembly (not shown) on any surface.

Figure 10:
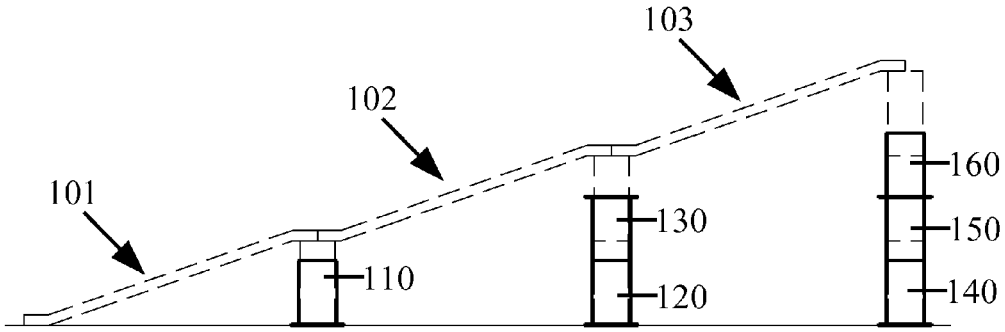
FIG. 10 shows a side view of another embodiment of the invention having one or more or support sleeves and one or more risers spaced apart from each other supporting a track above a surface in an ascending or descending configuration.

Referring now to FIG. 10, which illustrates another embodiment of the invention, where it is desired to raise the elevation of the track in an ascending or descending manner, with a plurality of risers and support sleeves spaced apart from each other. Here, tracks 101, 102, and 103 are shown to be coupled to each other and resting on top of a series of risers (not labeled) within support sleeves 110, 120, 130, 140, 150, and 160. Tracks 101-103 can either be individual components coupled to each other or integrated as one piece. It is apparent within the scope of the invention that any configuration or arrangement for the assembled track, risers, and support sleeves are possible, including but not limited to four or more risers and support sleeves mounted on top of each other forming one support pillar, leg, or stand or several spaced apart from each other, thus supporting an elongated track, bridge, lane, or walkway.

Still referring to FIG. 10, which illustrates another embodiment of the invention. Here, support sleeve 150 is shown to be mounted on sleeve 140 and sleeve 160 mounted on top of sleeve 150. In this configuration, the sleeve 150 is mounted in an inverted or upside-down configuration with its base or shoulder region facing up wherein the base or shoulder region of sleeve 160 rests on top of the base or shoulder region of sleeve 150. Further, sleeve 160 at least partially encloses a second riser and a third riser at their mating or junction point. The combination of the stacking arrangement of sleeves 140-160 and enclosed nature of the first, second and third risers (not labeled) via sleeves 140-160, provide a stable support for the risers and the entire track assembly. It is contemplated within the scope of the invention that either of sleeves 140, 150, or 160 can be stacked on top of each other in any configuration, or any number of sleeves can be used, or one sleeve used to enclose two or more blocks or risers.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in the following claims. Further, it will be understood that certain features and sub-combinations are of utility and may be employed without reference to other features and sub-combinations. This is contemplated by and is within the scope of the claims.

What is claimed is:

1. A support sleeve for a riser supporting an elevated toy vehicle trackway above a surface, the sleeve comprising:

a first end having an open end;

a second end having an open end;

one or more walls extending between the first end and second end, wherein the one or more walls define a hollow interior space for supporting the riser;

one or more supports extending outwardly from the perimeter of the first end; and wherein the support sleeve and a second support sleeve are configured to slide over the riser and at least partially enclose the riser.

2. The support sleeve of claim 1, wherein the one or more supports is a shoulder extending outwardly from the first end, wherein the shoulder encircles the perimeter of the first end.

3. The support sleeve of claim 1, wherein the one or more walls form a configuration of at least one or more of: a rectangle, square, cylinder, triangular, parallelogram, pentagon, hexagon, oval, ellipsoid, or a polygon having three or more sides.

4. The support sleeve of claim 1, wherein the one or more walls complement the configuration of the riser.

5. The support sleeve of claim 1, wherein the riser is a block.

6. The support sleeve of claim 5, wherein the block made of at least one or more of wood, plastic, metal, paper, rubber, or cardboard.

7. The support sleeve of claim 1, wherein the first end, second end, one or more walls, and one or more supports is one unitary component.

8. The support sleeve claim 1, wherein one or more of the first end, second end, one or more walls, and one or more supports are separate components assembled together.

9. The support sleeve of claim 1, wherein the support sleeve is made of at least one or more of wood, plastic, metal, paper, fiberglass, rubber, or cardboard.

10. The support sleeve of claim 1, wherein the second end of the support sleeve supports the second support sleeve.

11. The support sleeve of claim 1, wherein the second support sleeve is stacked in an inverted or upside-down configuration on top of the first support sleeve.

12. The support sleeve of claim 11, wherein a third support sleeve is stacked on the second support sleeve.

13. A method of stabilizing one or more toy vehicle tracks mounted on one or more track risers, comprising:

inserting a first track riser within a hollow interior space of a support sleeve having an open top end and an open base end, wherein the support sleeve and a second support sleeve slide over the riser and at least partially encloses the riser, and the base end having one or more outwardly projecting supports.

14. The method of claim 13, further comprising placing one or more tracks on top of the track riser, wherein the support sleeve stabilizes the first track riser via the one or more outwardly projecting supports.

15. The method of claim 13, wherein a second track riser is placed on top of the first track riser and the second support sleeve is placed over the second track riser forming a stacked configuration with the first support sleeve.

16. The method of claim 15, wherein the second support sleeve is placed over the second track riser in an inverted or upside-down configuration.

17. The method of claim 15, wherein the second support sleeve partially encloses the first track riser and the second track riser.

18. The method of claim 15, wherein a third support sleeve is stacked on the second support sleeve.

* * * * *